US008309287B2

(12) United States Patent
Ata et al.

(10) Patent No.: US 8,309,287 B2
(45) Date of Patent: Nov. 13, 2012

(54) DEVELOPING ROLLER, ELECTROPHOTOGRAPHIC PROCESS CARTRIDGE AND ELECTROPHOTOGRAPHIC IMAGE-FORMING APPARATUS

(75) Inventors: Yosuke Ata, Suntou-gun (JP); Genya Anan, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 351 days.

(21) Appl. No.: 12/553,382

(22) Filed: Sep. 3, 2009

(65) Prior Publication Data

US 2010/0068664 A1 Mar. 18, 2010

(30) Foreign Application Priority Data

Sep. 12, 2008 (JP) ..... 2008-234777

(51) Int. Cl.
*G03G 15/04* (2006.01)

(52) U.S. Cl. ..... 430/66; 430/133; 399/265; 399/286; 492/53; 492/54; 492/56

(58) Field of Classification Search ..... 430/66, 430/133; 399/286, 265; 492/53, 54, 56
See application file for complete search history.

(56) References Cited

U.S. PATENT DOCUMENTS

| | | | | |
|---|---|---|---|---|
| 7,627,276 | B2 * | 12/2009 | Anan et al. | 399/286 |
| 2008/0317515 | A1 * | 12/2008 | Anan et al. | 399/286 |
| 2010/0046989 | A1 * | 2/2010 | Anan et al. | 399/286 |

FOREIGN PATENT DOCUMENTS

| | | |
|---|---|---|
| JP | 1-124881 | 5/1989 |
| JP | 2-32380 | 2/1990 |
| JP | 9-62086 | 3/1997 |

* cited by examiner

*Primary Examiner* — Thorl Chea
(74) *Attorney, Agent, or Firm* — Fitzpatrick, Cella, Harper & Scinto

(57) ABSTRACT

A developing roller has a mandrel, an elastic layer and a cover layer as a surface layer. The cover layer includes a silicon oxide film containing a carbon atom chemically bonded to a silicon atom. In the silicon oxide film, the proportion of the total number of the elements of silicon, oxygen, carbon and hydrogen to the number of all detected elements, as detected with a high-frequency glow discharge light-emission surface analysis method, is 90% or more. The silicon oxide film has an abundance ratio of an oxygen atom chemically bonded to a silicon atom to silicon atoms, (O/Si), of 0.65 or more but 1.95 or less and an abundance ratio of a carbon atom chemically bonded to a silicon atom to silicon atoms, (C/Si), of 0.05 or more but 1.65 or less, and has a ratio of the maximum value to the minimum value of the (C/Si) in a thickness direction of the cover layer, of 1.50 to 33.00.

6 Claims, 4 Drawing Sheets

DEVELOPING ROLLER, ELECTROPHOTOGRAPHIC PROCESS CARTRIDGE AND ELECTROPHOTOGRAPHIC IMAGE-FORMING APPARATUS

BACKGROUND OF THE INVENTION

1. Field of the Invention

The present invention relates to a developing roller to be used in an electrophotographic image-forming apparatus such as a copying machine and a laser printer, and an electrophotographic process cartridge and an electrophotographic image-forming apparatus which are provided with the developing roller.

2. Description of the Related Art

A contact developing method of making a developing roller carry a toner and abut on a photosensitive drum to develop an image is known as a developing method of visualizing an electrostatic latent image existing on the photosensitive drum with the use of the toner.

Many developing rollers provided with an elastic layer are proposed as a developing roller to be used for the contact developing method. This is because such a developing roller hardly damages a toner image formed on the surface of the photosensitive drum and can secure a predetermined quantity of nip width on an abutting portion against the photosensitive drum.

However, when such an elastic layer is a surface layer of the developing roller, the surface of the developing roller occasionally shows strong stickiness. When the surface of the developing roller shows strong stickiness (tackiness), a conveyed developer adheres to the surface of the developing roller, and becomes not easily detached. The developer remaining on the surface of the developing roller is repeatedly pressurized between the developing roller and the photosensitive drum, and is gradually deteriorated. As a result, the developer occasionally sticks to the surface of the developing roller. In order to inhibit the tackiness of the surface of the developing roller, Japanese Patent Application Laid-Open No. H09-62086 discloses an invention of depositing inorganic particles on the surface of the developing roller to enhance the release properties of a toner (developer). However, according to the investigation of the present inventors, these inorganic particles were easily detached from the surface of the developing roller, and it was difficult to maintain an effect of inhibiting the developer from sticking to the surface of the developing roller for a long period of time. In addition, the invention described in the above described Japanese Patent Application Laid-Open No. H09-62086 had difficulty in inhibiting a low-molecular-weight substance which was unavoidably contained in the elastic layer from bleeding to the surface of the developing roller.

Furthermore, the above described Japanese Patent Application Laid-Open No. H09-62086 discloses that a developing roller having a resin coating layer provided on the surface of the elastic layer was proposed as a conventional technique and that such a resin coating layer had insufficient flexibility and insufficient adhesiveness to the elastic layer, so that the resin coating layer might cause a crack or peeling due to change with time.

SUMMARY OF THE INVENTION

With respect to the above described circumstances, the present inventors have arrived at recognition that a developing roller which is used for a contact developing method and is provided with an elastic layer needs to have a surface layer with the following functions of:

1. being capable of effectively inhibiting a low-molecular-weight substance from bleeding to the surface from the elastic layer;

2. having a surface superior in toner-releasing properties; and 3. having such a sufficient flexibility as to adequately follow the expansion and contraction of the elastic layer in various environments from low temperature to high temperature and to hardly cause peeling and a crack of the layer.

Therefore, the present invention is directed to providing a developing roller provided with a surface layer which has all of the above described functions 1 to 3 at a high level, and a production method therefor.

In addition, the present invention is directed to providing a developing method which can stably form an electrophotographic image of high quality, an electrophotographic image-forming apparatus and an electrophotographic process cartridge.

The present inventors have made an investigation in order to obtain the above described developing roller. As a result, the present inventors have found that a particular silicon oxide film could be used as the surface layer of the developing roller having all of the above described requirements 1 to 3, and accomplished the present invention.

According to one aspect of the present invention, there is provided a developing roller comprising a mandrel, an elastic layer and a cover layer provided on the outermost periphery, wherein the cover layer comprises a silicon oxide film containing a carbon atom chemically bonded to a silicon atom, and in the silicon oxide film, the proportion of the total number of the existing elements of a silicon atom, an oxygen atom, a carbon atom and a hydrogen atom to the number of all detected element, as detected by using a high-frequency glow discharge light-emission surface analysis method, is 90% or more, and the silicon oxide film has an abundance ratio of an oxygen atom chemically bonded to a silicon atom to silicon atoms, (O/Si), of 0.65 or more but 1.95 or less and an abundance ratio of a carbon atom chemically bonded to a silicon atom to silicon atoms, (C/Si), of 0.05 or more but 1.65 or less, and has a ratio of the maximum value to the minimum value of the abundance ratio (C/Si) in a thickness direction of the cover layer, of 1.5 to 33.0.

According to another aspect of the present invention, there is provided a developing method comprising pressing a layer of a developer having a toner to a photosensitive member by using a developing roller which has the layer of the developer formed on the surface and supplying the developer onto the surface of the photosensitive member to form a toner image thereon, wherein the developing roller is the above described developing roller.

According to a further aspect of the present invention, there is provided an electrophotographic process cartridge which is detachably mountable to the main body of the electrophotographic image-forming apparatus and comprises a developer having a toner, a developer container which accommodates the developer, a developer-quantity regulating blade, a photosensitive drum and a developing roller which is brought into pressure contact with the photosensitive drum, wherein the developing roller is the above described developing roller.

According to a further aspect of the present invention, there is provided an electro photographic image-forming apparatus comprising a photosensitive drum and a developing roller which is brought into pressure contact with the photosensitive drum, wherein the developing roller is the above described developing roller.

The present invention can provide a developing roller provided with a surface layer which can effectively inhibit a low-molecular-weight substance from bleeding to the surface from the elastic layer, has a surface superior in toner-releasing properties, and has such a sufficient flexibility as to adequately follow the expansion and contraction of the elastic layer in various environments from low temperature to high temperature and to hardly cause peeling and a crack of the layer. As a result, the present invention can stably form electrophotographic images of high quality in various environments.

Further features of the present invention will become apparent from the following description of exemplary embodiments with reference to the attached drawings.

DESCRIPTION OF THE EMBODIMENTS

Figure 1:
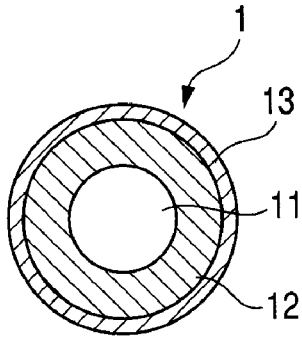
FIG. 1 is a cross-sectional view of one example of a developing roller.

FIG. 1 is a cross-sectional view of a developing roller 1 according to the present invention in a direction perpendicular to an axial direction.

The developing roller 1 has a mandrel 11 which is formed from an electroconductive material such as a metal, an elastic layer 12 which is formed on the outer peripheral face thereof, and a cover layer 13 functioning as a surface layer.

<Mandrel>

A mandrel 11 is columnar in this figure, but may be hollow cylindrical, and may be formed from an electroconductive material except a metal.

A developing roller 1 is generally used in a state in which an electric bias is applied thereto or of being grounded. Therefore, the mandrel 11 is a supporting member, and simultaneously needs to make at least the surface thereof electroconductive in order to be an electroconductive material. In other words, the mandrel 11 makes at least the outer peripheral face formed from a material which is sufficiently electroconductive to apply a predetermined voltage to an elastic layer 12 to be formed thereon, and the material specifically includes a metal or an alloy such as Al, a Cu alloy and SUS, and an iron or a synthetic resin which has been Cr-plated or Ni-plated. In a developing roller used for an electrophotographic image-forming apparatus, it is appropriate that the outer diameter of the mandrel 11 is usually in a range from 4 mm to 10 mm.

<Elastic Layer>

An elastic layer is formed by using rubber or a resin (which may collectively be referred to as "rubber material" hereinafter) as a main component of a raw material.

Various rubbers can be used as the rubber that is the main component of the raw material, and specifically includes the following rubbers: ethylene-propylene-diene copolymer rubber (EPDM), acrylonitrile-butadiene rubber (NBR), chloroprene rubber (CR), natural rubber (NR), isoprene rubber (IR), styrene-butadiene rubber (SBR), fluororubber, silicone rubber, epichlorohydrin rubber, butadiene rubber (BR), NBR hydride, polysulfide rubber and urethane rubber.

In addition, a resin to be used for the main component of the raw material is mainly a thermoplastic resin. Specifically, the following resins are cited: polyethylene resins (low-density polyethylene (LDPE), high-density polyethylene (HDPE), straight-chain low-density polyethylene (LLDPE), ethylene-vinyl acetate copolymer resin (EVA) and the like); polypropylene resins; polycarbonate resins; polystyrene resins; ABS resins; polyester resins (polyethylene terephthalate, polybutylene terephthalate and the like); fluororesins; and polyamide resins (polyamide 6, polyamide 66 and MXD6). These rubber materials may be used singly or in a form of two or more of them being mixed.

The elastic layer is preferably be given a moderately low hardness and a sufficient deformation-recovery force. For that purpose, a liquid silicone rubber and a liquid urethane rubber are preferably used as a raw material of the elastic layer. An addition reaction cross-linking type liquid silicone rubber may more preferably be used because of having adequate processability, a high stability of dimensional accuracy, and such a superior productivity as not to produce a reaction by-product or the like during a curing reaction.

The elastic layer may appropriately contain a conductive agent, a filler, an extender, an oxidation inhibitor, a processing auxiliary and the like, in the rubber material that is the main component.

The conductive agent includes an ion conductive substance acting according to an ion conducting mechanism, and a conductivity-imparting agent acting according to an electron conducting mechanism. Any one of them may be used alne, but both of them can be used in combination.

The conductive agent acting according to an electron conducting mechanism includes the following substances: carbon-based substances such as carbon black and graphite; metals or alloys such as aluminum, silver, gold, a tin-lead alloy and a copper-nickel alloy; electroconductive metal oxides such as zinc oxide, titanium oxide, aluminum oxide, tin oxide, antimony oxide, indium oxide and silver oxide; and substances that are various fillers of which the surface is treated with copper, nickel or silver to be electroconductive.

The conductivity-imparting agent acting according to an ion conducting mechanism includes the following substances: salts of metals in Group 1 of the Periodic Table, such as $LiCF_3SO_3$, $NaClO_4$, $LaClO_4$, $LiAsF_6$, $LiBF_4$, NaSCN, KSCN and NaCl; ammonium salts such as $NH_4Cl$, $(NH_4)_2SO_4$ and $NH_4NO_3$; salts of metals in Group 2 of the Periodic Table, such as $Ca(ClO_4)_2$ and $Ba(ClO_4)_2$; complexes of these salts with a polyalcohol such as 1,4-butanediol, ethylene glycol, polyethylene glycol, propylene glycol and polypropylene glycol, or with a derivative thereof; complexes of these salts with a monool such as ethylene glycol monomethyl ether, ethylene glycol monoethyl ether, polyethylene glycol monomethyl ether and polyethylene glycol monoethyl ether; cationic surfactants such as a quaternary ammonium salt; anionic surfactants such as an aliphatic sulfonate, an alkyl sulfate and an alkyl phosphate; and amphoteric surfactants such as betaine. These conductive agents can be used singly or in a form of two or more of them being mixed.

Among these, the carbon black type of the conductive agent is preferred because of being easily available at relatively low costs and also being capable of imparting adequate conductivity to the elastic layer without depending on the type of a rubber material which is the main component of the raw material. Conventionally used means, for instance, such as a roll kneader, a Banbury mixer and a biaxial extruder, may be appropriately used according to the rubber material, as a means for dispersing a fine powder of the conductive agent into the rubber material that is the main component of the raw material.

The filler and the extender include the following substances: silica, fine powder of quartz, diatomaceous earth, zinc oxide, basic magnesium carbonate, active calcium carbonate, magnesium silicate, aluminum silicate, titanium dioxide, talc, mica powder, aluminum sulfate, calcium sulfate, barium sulfate, glass fiber, an organic reinforcing agent and an organic filler. The surfaces of these fillers may be treated with an organosilicon compound to acquire hydrophobicity thereon.

Known oxidation inhibitors used for a polymer compound, such as a hindered phenol-based oxidation inhibitor, a phenol-based oxidation inhibitor, a phosphate-based oxidation inhibitor, an amine-based oxidation inhibitor and a sulfur-based oxidation inhibitor, may be appropriately selected and used as the oxidation inhibitor.

Known materials may be used as the processing auxiliaries. Specifically, fatty acids such as stearic acid and oleic acid, and metal salts and esters of fatty acids may be used.

The elastic layer which mainly contains a silicone rubber is prepared by using a liquid silicone rubber as a main agent, polyorganohydrogen siloxane as a crosslinking component, and a platinum-based catalyst to crosslink the rubber components with each other.

In order to secure a nip width between the elastic layer and a photosensitive drum which are brought into pressure contact with each other and decrease a permanent compression distortion (set), the elastic layer may be formed in a thickness of preferably 0.5 mm or more, further preferably 1.0 mm or more. There is no particular upper limit for the thickness of the elastic layer unless the precision of the outer diameter of the developing roller to be prepared is impaired. However, if the thickness of the elastic layer became excessively large, a pressure contact portion is largely deformed and the set is occasionally apt to be formed, when the developing roller and the photosensitive member or a toner-quantity regulating blade are brought into pressure contact with each other and allowed to stand for a long period of time. Therefore, from a practical point of view, the thickness of the elastic layer may preferably be 6.0 mm or less, more preferably 5.0 mm or less. In order to attain the aiming nip width, it is desirable to appropriately determine the thickness of the elastic layer according to the hardness of the layer.

The elastic layer can be formed by conventionally-known extrusion molding methods and injection molding methods, but there is no particular limitation on the methods. The layer structure of the elastic layer is not limited as long as the structure has the features described in connection with the present invention, and can include a structure composed of two or more layers.

Figure 2:
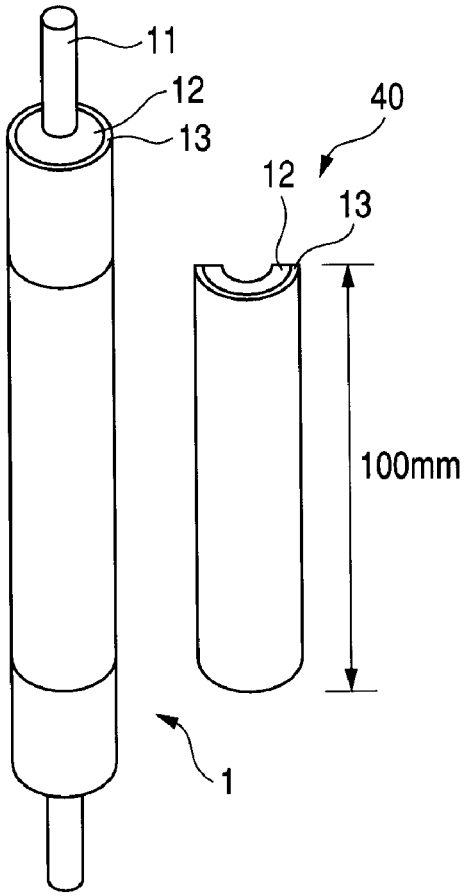
FIG. 2 is an explanatory view illustrating a method of collecting a test piece for the measurement of a tensile modulus.

The tensile modulus of an elastic layer, in an aspect of the tensile modulus measured on a stacked body of a cover layer and the elastic layer, which is prepared according to FIG. 2 so as to correspond to the half of the perimeter of the roller, is preferably 1.0 MPa or more but 100.0 MPa or less, and more preferably 1.0 MPa or more but 30.0 MPa or less. By setting the tensile modulus within the above described numerical value range, the permanent compression distortion results in hardly occurring. In addition, the nip width in which the developing roller is in contact with a pressure contact member does not become excessively small, and accordingly an excessively high pressure is not applied to the toner which passes between the developing roller and the photosensitive member, and the toner can be effectively inhibited from sticking to an elastic roller and causing filming.

The tensile modulus in the present invention is measured according to the method described in JIS-K7113 (1995). In the present invention, as illustrated in FIG. 2, a sample having a length of 100 mm and corresponding to the half of the perimeter of the roller is cut out from the developing roller 1 and it is used as a test piece 40.

The universal tensile tester (trade name: Tensilon RTC-1250A; made by ORIENTEC CO., LTD.) is used for measurement, and the measurement environment is set at a temperature of 20±3° C. and a humidity of 60±10% RH. Then, the measurement is performed by setting 10 mm of each end of the test piece in a chuck, setting a length between chucks at 80 mm and setting a measurement speed at 20 mm/min. The measurement is repeated with five specimens, and the average value is defined as the tensile modulus of the test piece.

<Cover Layer>

A cover layer as a surface layer comprises a silicon oxide film containing carbon atoms chemically bonded to silicon atoms. In the silicon oxide film, the proportion of the total number of existing elements of a silicon atom, an oxygen atom, a carbon atom and a hydrogen atom, with respect to all detected element numbers which are detected by using a high-frequency glow discharge light-emission surface analysis method, is 90% or more.

When the proportion of the total number of the existing elements of a silicon atom, an oxygen atom, a carbon atom and a hydrogen atom in the silicon oxide film containing carbon atoms chemically bonded to silicon atoms, with respect to all detected element numbers, is less than 90%, the silicon oxide hardly forms a film and tends to exist on the surface of the elastic layer in a state of being interspersed into an island shape. In such a state, it is difficult for the silicon compound to inhibit the low-molecular-weight substance which is contained in the elastic layer from bleeding to the surface of the developing roller.

The number of all elements including light elements which are contained in the silicon oxide film can be measured with the high-frequency glow discharge light-emission surface analysis method. Such an apparatus may include a glow discharge light-emission analyzer (trade name: GD-PROFILER 2-type GD-OES; made by HORIBA, Ltd.). In the present invention, the number of all elements was measured by using the above described glow discharge light-emission analyzer in the following conditions:

measurement mode: pulse sputtering;
diameter of anode (analyzed area): diameter of 4 mm;
electric discharge power: 35 W; and
pressure of Ar gas: 600 Pa.

In the silicon oxide film according to the present invention, the abundance ratio of oxygen atoms chemically bonded to silicon atoms to the silicon atoms, (O/Si), is 0.65 or more but 1.95 or less, and the abundance ratio of carbon atoms chemically bonded to silicon atoms to the silicon atoms, (C/Si), is 0.05 or more but 1.65 or less.

Generally, the silicon oxide film is a very hard film because a chemical bond (Si—O bond) between a silicon atom and an oxygen atom is strong and forms a dense network structure. The silicon oxide film can be flexibilized by introducing an Si—C bond having weaker bond energy than that of the Si—O bond into such a silicon oxide film. On the other hand, when the relative amount of the Si—O bond in the silicon oxide film decreases, the hardness of the silicon oxide film is lowered.

Therefore, when the abundance ratio of an oxygen atom which forms a chemical bond with a silicon atom to silicon atoms, (O/Si), (hereinafter abbreviated as "(O/Si)") is less than 0.65, abrasion resistance is lowered due to the decrease in the amount of the Si—O bond in the silicon oxide film. When the (O/Si) is larger than 1.95, the Si—O bond in the cover layer increases, the hardness increases, and the flexibility of the coating film tends to be impaired. Therefore, a crack may be formed due to the stress of the silicon oxide film. Such a crack occasionally may cause a defect like a streak in electrophotographic images.

When the abundance ratio of a carbon atom which forms a chemical bond with a silicon atom to silicon atoms, (C/Si), (hereinafter abbreviated as "(C/Si)") is less than 0.05, the silicon oxide film becomes hard. Then, when the silicon oxide film is brought into pressure contact with a pressure contact member such as a photosensitive member and a toner-amount-regulating blade, the silicon compound film tends to cause a crack. In addition, when the (C/Si) exceeds 1.65, the adhesiveness of the silicon oxide film to the elastic layer is lowered, and the cover layer is apt to be peeled from the elastic layer.

The adhesiveness between the silicon oxide film and the elastic layer is considered to originate in an intermolecular force between hydroxyl groups existing on the surface of the elastic layer and oxygen atoms in the silicon oxide film. Therefore, it is considered that in the silicon oxide film having (C/Si) of exceeding 1.65, the amount of the oxygen atoms bonded to the silicon atoms decreases, and accordingly that the adhesiveness is lowered.

In the silicon oxide film according to the present invention, the ratio of the maximum value to the minimum value of the abundance ratio (C/Si), (maximum value/minimum value), in the thickness direction of the silicon oxide film is 1.5 to 33.0.

By changing the C/Si in the cover layer in the depth direction, the stress in the silicon oxide film in this manner can be alleviated, and a crack can be effectively inhibited from being formed in the cover layer even when the elastic layer is largely expanded or contracted in various environments.

Here, when the ratio of the maximum value to the minimum value of (C/Si) in the thickness direction of the cover layer is less than 1.5, the composition in the cover layer becomes approximately uniform in the thickness direction, so that the tensile stress in the silicon oxide film is hardly alleviated. For that reason, when the elastic layer is largely expanded or contracted in a severe environment such as a high-temperature and high-humidity environment, the cover layer cannot follow the expansion and contraction of the elastic layer, and the crack may be occasionally formed on the surface of the developing roller.

On the other hand, when the ratio of the maximum value to the minimum value of (C/Si) is larger than 33.0, the value of (C/Si) in the silicon oxide film which constitutes the cover layer exceeds a number range of 0.05 to 1.65, the crack is formed due to increased hardness of the film, and the adhesiveness between the silicon oxide film and the elastic layer is lowered due to decreased Si—O bonds in the silicon oxide film.

Here, the maximum value and the minimum value in the thickness direction of the cover layer mean the maximum value and the minimum value among values of the (C/Si) which are measured at respective points of 10%, 20%, 30%, 40%, 50%, 60%, 70%, 80% and 90% of the thickness of the cover layer, deep in the thickness direction from the top surface of the cover layer.

The thickness of the cover layer is preferably 30 nm or more but 5,000 nm or less, more preferably 300 nm or more but 3,000 nm or less. When the thickness of the cover layer is controlled so as to be within the above described numerical value range, the durability of the developing roller becomes satisfactory. When the developing roller is brought into pressure contact with a pressure contact member such as a photosensitive member and a toner-quantity regulating blade, a crack or the like can be effectively inhibited from being formed on the cover layer.

In the above description, the thickness X of the formed silicon oxide film containing carbon is defined as an average value of values obtained by measuring the thickness at 9 spots in total of 3 spots equally spaced in the circumferential direction of the developing roller for each of 3 spots equally spaced in the lengthwise direction from an end portion. In this connection, a thin film measurement instrument (trade name: F20-EXR; made by FILMETRICS, Inc.) was used for the measurement, and the index of refraction of the silicon oxide film containing carbon at the measurement time was set at 1.42.

The silicon oxide film having the above described structure is so flexible that it can follow a shape change of the elastic layer itself caused by the contraction and expansion due to an environmental variation. Furthermore, the flexibility can reduce the occurrence of a crack on the silicon oxide film can be reduced. Therefore, the bleed caused by the crack can also be reduced.

When the value of (C/Si) at a position 10 nm deep from the top surface of the cover layer is represented by A, and the value of (C/Si) at a position (X-10) nm deep from the top surface of the cover layer is represented by B, wherein X represents the thickness of the cover layer, it is preferred that A and B satisfy the following inequalities (1) and (2):

$$0.90<A\leqq 1.65 \quad (1); \text{ and}$$

$$0.05\leqq B\leqq 0.90 \quad (2).$$

As for the above described inequality (1), by controlling the value of (C/Si) in the vicinity of the surface of the cover layer to more than 0.90 but 1.65 or less, the developing roller can effectively be inhibited from exhibiting stickiness on the surface. As a result, the toner can be inhibited from filming onto the surface of the developing roller, and consequently the developing roller can maintain adequate triboelectrification performance for a developer for a long period of time.

As for the above described inequality (2), by controlling the value of (C/Si) in the vicinity of the elastic layer of the cover layer to 0.05 or more but 0.90 or less, the cover layer acquires stronger adhesiveness between itself and the elastic layer. This is because the cover layer can secure an amount of oxygen atoms which exist in its region close to the elastic layer and contribute to the enhancement of the adhesiveness to the elastic layer.

Values of the (O/Si) and (C/Si), a chemically bonding state of an oxygen atom and a silicon atom, and a chemically bonding state of a carbon atom and a silicon atom, in the silicon oxide film can be determined with an X-ray photoelectron spectroscopy.

An X-ray photoelectron spectrometer (trade name: Quantum 2000; made by ULVAC-PHI, Inc.) can measure the abundance ratios of all the elements except light elements. Then, peaks originating in the bonding energy of the 2p orbit of Si and the 1s orbit of O and C on the surface of the cover layer 13 are measured by using AlKα as an X-ray source. The chemically bonding state of each atom and the abundance ratio of each element are calculated from the respective peaks, and element ratios (O/Si) and (C/Si) are determined from the obtained abundance ratios.

The above described glow discharge light-emission analyzer and X-ray photoelectron spectrometer can measure those values while sputtering the cover layer from the surface with the use of Ar plasma. Therefore, the measurement on the cover layer can be conducted in the depth direction.

The silicon oxide film may contain an element other than Si, O, C and H. In order to enhance the stability of the silicon oxide film, the silicon oxide film may preferably contain, for instance, at least one element selected from a nitrogen atom and a fluorine atom.

A method for forming the cover layer on the elastic layer may include the following methods: a wet coating method such as a dip coating method, a spray coating method, a roll coating method and a ring coating method; a physical vapor deposition (PVD) method such as a vacuum deposition method, a sputtering method and an ion plating method; and a chemical vapor deposition (CVD) method such as a plasma CVD method, a thermal CVD method and a laser CVD method.

Among them, the plasma CVD method is more preferable in consideration of a high adhesiveness between the elastic layer and the cover layer (silicon oxide film), a short processing period of time and a low processing temperature, simplified apparatus, and a uniformity of the resulting cover layer.

Figure 3:
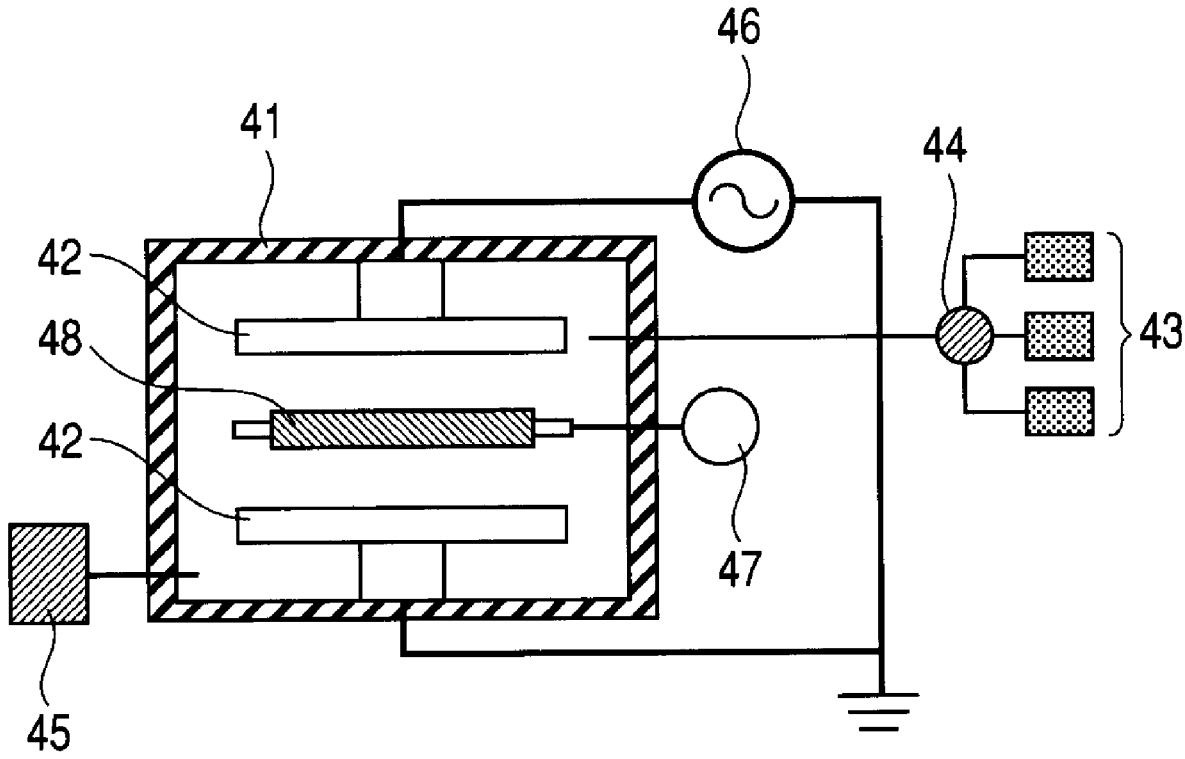
FIG. 3 is a schematic view of an apparatus for producing a silicon oxide film by a plasma CVD method.

An example of a method for forming a silicon compound film by a plasma CVD method will be described below. FIG. 3 is an explanatory drawing of an apparatus for forming a silicon compound film by the plasma CVD method.

The apparatus includes a vacuum chamber 41, plate electrodes 42 placed in parallel, a raw material gas cylinder and a raw material liquid tank 43, a raw material supply unit 44, a unit 45 for exhausting the gas in the chamber, a high-frequency supply power source 46 for supplying a high-frequency power, and a motor 47 for rotating an elastic roller 48.

A developing roller having a silicon oxide film containing carbon can be produced by the following procedures, while using the apparatus illustrated in FIG. 3.

Procedure (1): Place the elastic roller 48 having an elastic layer formed on a mandrel between the plate electrodes 42, and rotate the elastic roller 48 in the circumferential direction by driving the motor 47 so that a silicon oxide film containing carbon to be obtained is uniform.

Procedure (2): Evacuate the inside of the vacuum chamber 41 to 1 Pa or lower by operating the exhaust unit.

Procedure (3): Introduce a raw material gas from a raw material gas introduction port, supply a high-frequency power to the plate electrodes 42 from the high-frequency supply power source 46 to generate plasma for formation of a film.

Procedure (4): Stop the supply of the raw material gas and the high-frequency power, after a predetermined period of time has passed, introduce (leak) air or nitrogen into the vacuum chamber 41 until reaching atmospheric pressure, and then take out the elastic roller 48.

According to the procedures as described above, a developing roller having a silicon oxide film according to the present invention can be produced. In this connection, many elastic rollers 48 may be simultaneously treated by plasma CVD if they could be placed in a uniform plasma atmosphere.

Here, usually, a gaseous or gasified organosilicon compound is introduced into the vacuum chamber 41 as the raw material gas, together with a hydrocarbon compound as needed, in the coexistence of or in the absence of a gas such as an inert gas and an oxidizing gas.

The above described organosilicon compound includes the following compounds: 1,1,3,3-tetramethyldisiloxane, hexamethyldisiloxane, hexamethyldisilazane, vinyltrimethylsilane, methyltrimethoxysilane, hexamethyldisilane, methylsilane, dimethylsilane, trimethylsilane, tetramethylsilane, diethylsilane, propylsilane, phenylsilane, vinyltriethoxysilane, vinyltrimethoxysilane, tetramethoxysilane, tetraethoxysilane, phenyltrimethoxysilane, methyltriethoxysilane and octamethylcyclotetrasiloxane. Because of being easily handled, 1,1,3,3-tetramethyldisiloxane, hexamethyldisiloxane and tetramethylsilane can be used.

Silane, aminosilane and silazane can also be used as an Si source in addition to the above described organosilicon compounds.

When the organosilicon compound and the like are gaseous, they are used as they are. When the organosilicon compound and the like are liquid at room temperature, they are heated, vaporized, and conveyed by an inert gas, or bubbled by an inert gas and conveyed for use. Furthermore, when the organosilicon compound and the like are solid at room temperature, they are heated, vaporized, and conveyed by an inert gas for use. In addition, the vaporization of the raw material substances may be accelerated by being placed in a state of a reduced pressure.

A nitrogen-containing gas ($N_2O$, $N_2$ and ammonia) or an oxygen-containing gas (oxygen, $CO_2$ and CO) can also be introduced into the vacuum chamber, together with the above described raw material gas, or in addition to the raw material gas. In addition, an inert gas that can be used in the above described process includes a gas such as helium and argon.

The proportion of the number of elements of Si, O, C and H existing in the silicon oxide film with respect to the number of all elements can be controlled by managing a blending ratio of the raw material gases to be introduced, flow rates of the raw material gases when they are introduced, and a high-frequency power to be supplied.

The abundance ratio (C/Si) in the thickness direction of the silicon oxide film can also be controlled by changing a blending ratio of the raw material gases, the flow rates of the raw material gases when the raw material gases are introduced to the vacuum chamber, and the high-frequency power to be supplied, in the film-forming step. Specifically, for instance, when a mixture of the above described organosilicon compound and oxygen gas is used as the raw material gas, the (C/Si) on a surface side of the silicon oxide film can be increased by decreasing the ratio (volume ratio) of the oxygen gas to the organosilicon compound, in the film-forming step.

In addition, to form a silicon oxide film by means of a wet process, a mixture of an inorganic polymer precursor solution and a solution of a polymer having a hydroxyl group is uniformly applied onto an elastic layer, and thereafter treating the applied mixture with a curing unit such as a heater or a unit for irradiation with an ultraviolet light. Here, the surface of the elastic layer may be subjected to activation treatment such as irradiation treatment with an ultraviolet light or with an electron beam and plasma treatment, before the raw material mixture for forming a silicon oxide film is applied onto the elastic layer, so that the mixture can be well applied.

The developing roller according to the present invention is useful as a developing roller of an image-forming apparatus such as a copying machine, a facsimile and a printer, and also as a developing roller of a process cartridge in a process cartridge type image-forming apparatus. Furthermore, the developing roller according to the present invention is useful as a developing roller to be used for a developing method which presses the developing roller on the surface of which a thin layer of a developer having a toner is formed against a photosensitive member so that the thin layer of the developer comes to contact with the photosensitive member, and supplies the developer to the surface of the photosensitive member to form a toner image thereon.

Figure 4:
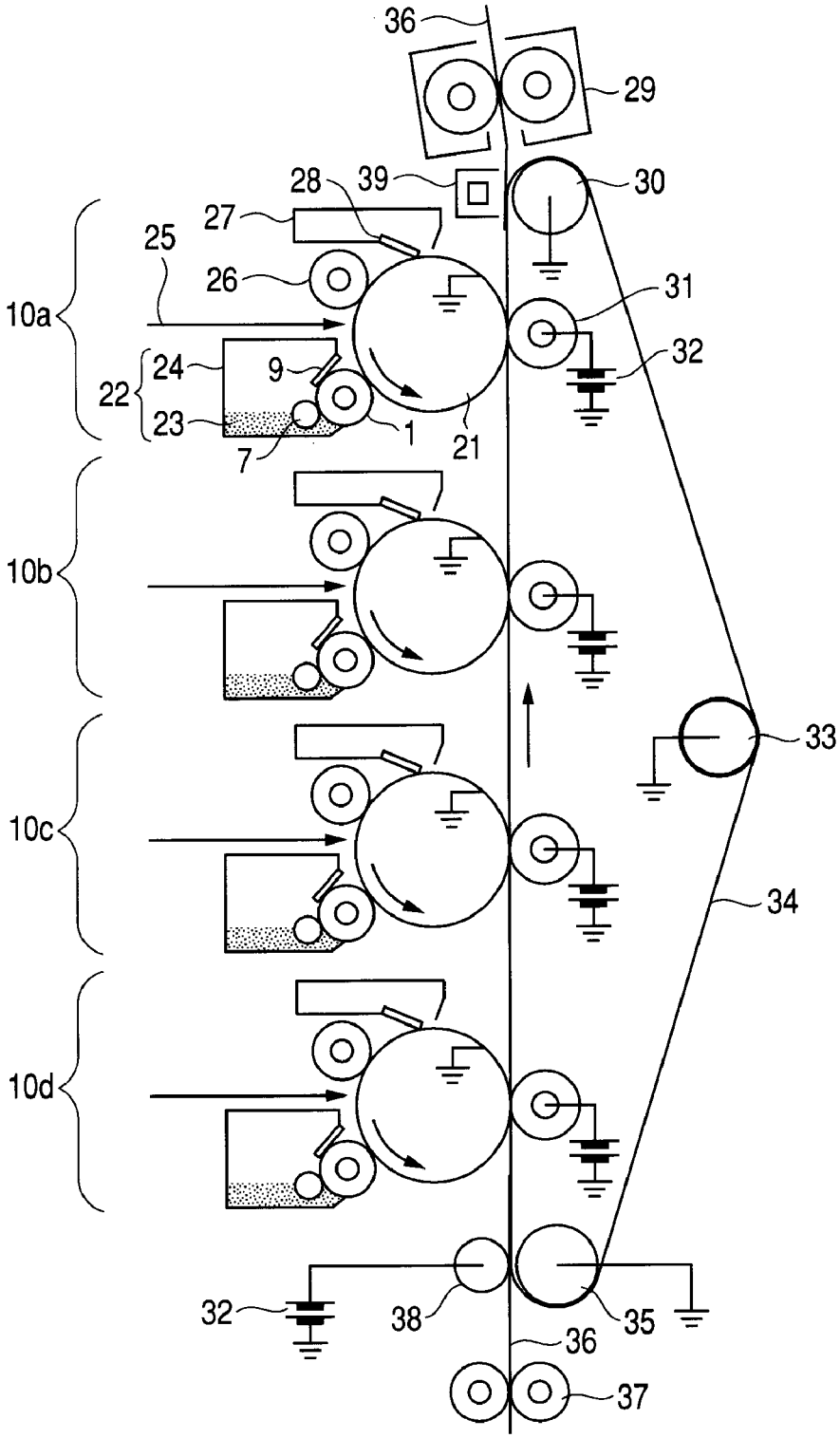
FIG. 4 is a schematic view illustrating one example of a developing apparatus having a developing roller according to the present invention mounted thereon.

One example of a color electrophotographic image-forming apparatus having the developing roller according to the present invention mounted thereon is illustrated in FIG. 4.

The color electrophotographic image-forming apparatus illustrated in FIG. 4 has image-forming portions 10*a* to 10*d* in a tandem form, which are provided for color toners of yellow Y, magenta M, cyan C and black BK, respectively. The image-forming portions 10*a*, 10*b*, 10*c* and 10*d* basically have the same structure. The image-forming portions 10*a* to 10*d* are provided with a photosensitive member 21 which functions as a latent image bearing body and rotates in the arrow direction. A charging roller 26 for uniformly and electrically charging the photosensitive member 21, a light exposure unit for irradiating the uniformly and electrically charged photosensitive member 21 with a laser light 25 to form an electrostatic latent image thereon, and a developing unit 22 which supplies a developer to the photosensitive member 21 on which the electrostatic latent image has been formed and develops the electrostatic latent image are provided around the photosensitive member 21. Furthermore, a transfer member is provided which has a transfer roller 31 for transferring a toner image existing on the photosensitive member 21 onto a recording medium (transfer material) 36 such as paper, which is fed by a paper-feeding roller 37 and conveyed by a conveying belt 34, while a voltage applied from a bias power source 32 is applied from the back surface of the recording medium 36. The conveying belt 34 is fitted over and around a driving roller 30, a driven roller 35 and a tension roller 33, and is controlled so as to move in synchronization with the image-forming portions and convey the recording medium 36 so that the toner images formed in the respective image-forming portions are sequentially superimposed and transferred onto the recording medium 36. The recording medium 36 is electrostatically adsorbed to the conveying belt 34 by the operation of an adsorption roller 38 placed right before the conveying belt 34, and results in being conveyed.

The photosensitive member 21 and the developing roller 1 are arranged so as to be in contact with each other at a predetermined abutting pressure and rotate in the same direction at a position at which the photosensitive member 21 is in contact with the developing roller 1. In this connection, the developing roller 1 can also be used in a state in which the developing roller is not in contact with the photosensitive member 21, and at this time, is provided proximate to the photosensitive member.

Furthermore, the toner images which have been superimposed and transferred onto the recording medium 36 are fixed by a fixing apparatus 29, and then the recording medium 36 is discharged to the outside of the electrophotographic image-forming apparatus by an unshown conveying apparatus. The recording medium 36 is peeled from the conveying belt 34 by the operation of a peeling apparatus 39 and results in being sent to the fixing apparatus 29.

The image-forming portion 10 is provided with a cleaning member having a cleaning blade 28 which removes the transfer residual toner that has not been transferred to the recording medium and remains on the photosensitive member 21, and a waste developer container 27 for storing the developer therein which has been scraped off from the photosensitive member. The cleaned photosensitive member 21 is made capable of forming an image and stands ready for forming a next image.

It is also possible to integrate only the developing apparatus 22, or the photosensitive member 21, the charging member 26, the developing apparatus 22, the cleaning blade 28 and the waste developer container 27, into a detachable process cartridge which can be detachably mountable to the main body of the electrophotographic apparatus.

The developing apparatus 22 installed in the above described image-forming portion 10 is provided with a developer container 24 which accommodates a developer 23 and with the developing roller 1 which is arranged so as to block the opening of the developer container and oppose to the photosensitive member in the portion exposed from the developer container. The developer container 24 is provided in its interior with a roller-shaped developer-applying member 7 which abuts on the developing roller 1 and supplies the developer to the developing roller 1 and with a developer-quantity regulating blade 9 which forms the developer having been supplied to the developing roller 1 into a thin film and imparts a triboelectric charge to the developer.

As the developer-applying member 7, for instance, a member in which a foam sponge or polyurethane foam is formed on a mandrel or a member having a fur brush structure in which fibers of rayon or polyamide are implanted is preferred because of adequately removing the residual developer on the developing roller 1. The developer-applying member 7 may preferably be arranged so as to have a suitable abutment width on the developing roller 1, and may preferably be rotated in the direction counter to the developing roller 1 in the abutting portion.

Figure 5:
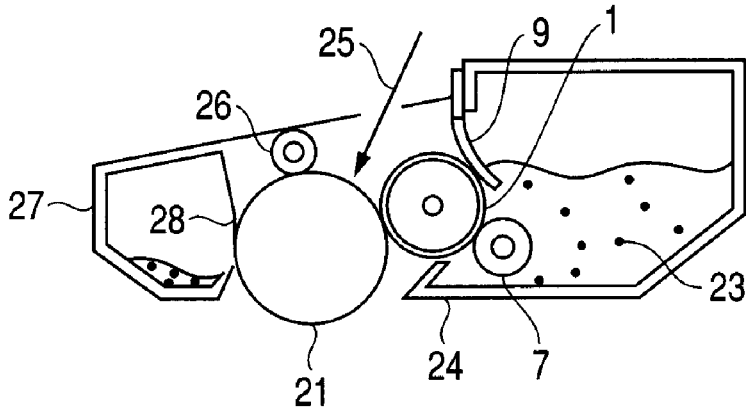
FIG. 5 is a schematic view illustrating a process cartridge having a developing roller according to the present invention mounted thereon.
Figure 6:
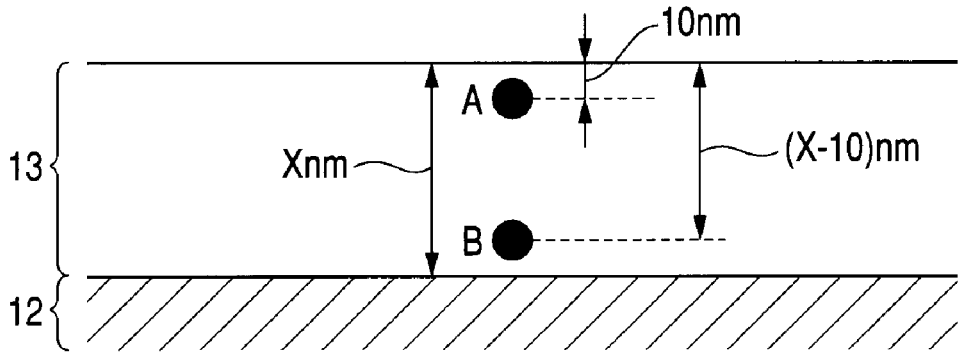
FIG. 6 is a schematic view for describing measurement points A and B of a cover layer of a developing roller according to the present invention.

A process cartridge according to the present invention is detachable from the main body of the electrophotographic apparatus, and includes the above described developing roller, as described above. A schematic view of one example of the process cartridge for a monochrome image-forming apparatus is illustrated in FIG. 5.

The developing roller 1 is mounted in a state of being in contact with the photosensitive member 21 and the developer-applying member 7. The developer 23 placed in the developer container 24 can be supplied to the developing roller 1 by means of the developer-applying member 7. In this case, the quantity of the developer is adjusted by the developer-quantity regulating blade 9. On the other hand, by means of a laser light 25, an electrostatic latent image is formed on the photosensitive member 21 electrically charged with the charging member 26, and the electrostatic latent image is converted into a visible image by means of the toner which has been carried on and conveyed by the developing roller 1, thereby forming a toner image. This toner image on the photosensitive member 21 is transferred onto a recording medium such as paper. Then, the developer remaining on the photosensitive member 21 is scraped out and is scraped off into the waste developer container 27 by the cleaning blade 28.

EXAMPLES

The present invention will be more specifically described below by way of showing examples, but the present invention is not limited thereto.

In addition, the purity of used reagents is 99.5% or more unless otherwise specified, except those which are described below.

(1) Raw Rubber Material for Elastic Layer

Liquid silicone rubber: dimethylpolysiloxane having a vinyl group at both ends (in which vinyl group content was 0.15 mass %) and a dimethylsiloxane-methylhydrogensiloxane copolymer having an Si—H group at both ends (in which the content of H bonded to Si atoms was 0.30%) were used. A complex (0.5 mass %) of chloroplatinic acid and divinyltetramethyldisiloxane was used as a curing catalyst.

Olefin-based elastomer "Santoprene 8211-25" (which is trade name and is made by Advanced Elastomer Systems Japan Ltd.), Olefin-based elastomer "Santoprene 8211-45" (which is trade name and is made by Advanced Elastomer Systems Japan Ltd.), LDPE "NOVATEC LD LJ902" (which is trade name and is made by Japan Polyethylene Corporation), LDPE "NOVATEC LD LJ802" (which is trade name and is made by Japan Polyethylene Corporation)

EVA "EVAFLEX EV45LX" (which is trade name and is made by DUPONT-MITSUI POLYCHEMICALS CO., LTD.)

(2) Other Components for Elastic Layer;

Quartz powder "Min-USil" (which is trade name and is made by Pennsylvania Glass Sand Corporation), Carbon black "DENKA BLACK" (which is trade name, is made by DENKI KAGAKU KOGYO KABUSHIKI KAISHA and is powdery product), and MT carbon black "Thermax Floform N990" (which is trade name and is made by CANCARB Ltd.).

Production Example 1 (Production of Elastic Roller 1)

7 Parts by mass of a quartz powder and 10 parts by mass of carbon black as fillers were blended with 100 parts by mass of dimethylpolysiloxane having a vinyl group at both ends (in which vinyl group content was 0.15 mass %). Subsequently, the blend was mixed and defoamed by using a planetary mixer and was used as a base material of liquid silicone rubber. 0.5 Parts by mass of a complex of chloroplatinic acid and divinyltetramethyldisiloxane, which functions as a curing catalyst, was blended with this base material to prepare a solution (A). In addition, 1.5 parts by mass of a dimethylsiloxane-methylhydrogensiloxane copolymer having an Si—H group at both ends (in which the content of H bonded to Si atoms was 0.30%) was blended with the above described base material to prepare a solution (B)

On the other hand, a columnar mandrel made from an SUM material, having a diameter of 6 mm and a length of 250 mm and having a surface treated with a primer was arranged in the center of a cylindrical die. A mixture solution which had been prepared by mixing the above described solution (A) and solution (B) in a mass ratio of 1:1 with the use of a static mixer was injected into this die and cured by heating the die at a temperature of 130° C. for 20 minutes. Then, the product was demolded. Thereafter, the product was heated in a thermostatic oven at a temperature of 200° C. for 4 hours to obtain an elastic roller 1 having an elastic layer with a length of 240 mm and a thickness of 3 mm.

Production Example 2 (Production of Elastic Roller 2)

100 Parts by mass of a polyolefin-based elastomer "Santoprene 8211-25" (trade name) and 40 parts by mass of MT carbon black were pelletized with the use of a twin screw extruder having a diameter of 30 mm and L/D of 32 to obtain a resin composition. The resin composition was crosshead-extrusion-molded to form a resin layer on a mandrel (with a diameter of 6 mm and a length of 250 mm). The resin layer was cut at the ends and the resin layer portion was ground with a rotary grinding stone to obtain an elastic roller 2 having an elastic layer with a length of 240 mm and a thickness of 3 mm.

Production Example 3 (Production of Elastic Roller 3)

An elastic roller 3 was obtained in a similar way to that in the Production Example 2, except that an olefin-based elastomer "Santoprene 8211-45" (trade name) was used in place of the polyolefin-based elastomer "Santoprene 8211-25" (trade name).

Production Example 4 (Production of Elastic Roller 4)

An elastic roller 4 was obtained in a similar way to that in the Production Example 2, except that LDPE "Novatec LD LJ902" (trade name) was used in place of the polyolefin-based elastomer "Santoprene 8211-25" (trade name).

Production Example 5 (Production of Elastic Roller 5)

An elastic roller 5 was obtained in a similar way to that in the Production Example 2, except that LDPE "Novatec LD LJ802" (trade name) was used in place of the polyolefin-based elastomer "Santoprene 8211-25" (trade name).

Production Example 6 (Production of Elastic Roller 6)

An elastic roller 6 was obtained in a similar way to that in the Production Example 2, except that EVA "EVAFLEX EV45LX" (trade name) was used in place of the polyolefin-based elastomer "Santoprene 8211-25" (trade name).

Example 1

The elastic roller 1 in Production Example 1 was placed in a vacuum chamber 41 of a plasma CVD apparatus illustrated in FIG. 3, and then the pressure in the vacuum chamber 41 was reduced to 1 Pa by using a vacuum pump.

(First Film-Forming Step)

Subsequently, a mixture gas of 10 sccm of hexamethyldisiloxane vapor and 300 sccm of oxygen as a raw material gas was introduced into the vacuum chamber, and the pressure in the vacuum chamber was adjusted so as to be 55 Pa. After the pressure became constant, an electric power of 70 W with a frequency of 13.56 MHz was supplied to plate electrodes 42 from a high-frequency power source 46 to generate plasma between the plate electrodes 42. The elastic roller 1 in the vacuum chamber was rotated at 10 rpm and treated for 218 seconds.

(Second Film-Forming Step)

Subsequently, a mixture gas of 20 sccm of hexamethyldisiloxane vapor and 30 sccm of oxygen was introduced into the vacuum chamber, and the pressure in the vacuum chamber was adjusted so as to be 13 Pa. After the pressure became constant, an electric power of 200 W with a frequency of 13.56 MHz was supplied to the plate electrodes 42 from the high-frequency power source 46 to generate plasma between the plate electrodes 42. The elastic roller 1 in the vacuum chamber was rotated at 10 rpm and treated for 410 seconds.

After the treatment was finished, power supply was stopped, the raw material gas remaining in the vacuum chamber was evacuated, and air was introduced into the vacuum chamber until the inner pressure reached atmospheric pressure. Then, a developing roller having a cover layer formed thereon was taken out.

The thickness of the cover layer of the obtained developing roller was measured by using a thin film measuring apparatus "F20-EXR" (trade name).

The proportion of the total number of existing elements of Si, O, C and H with respect to all elements on the surface of the developing roller was determined with a high-frequency glow discharge light-emission surface analysis method.

In addition, values of the (C/Si) and (O/Si) in the thickness direction of the cover layer were measured with an X-ray photoelectron spectroscopy, and the maximum value and the minimum value of the respective values were determined. A test piece was prepared from the developing roller so as to have a length of 100 mm and correspond to the half of the perimeter of the roller as shown in FIG. 2, and the tensile modulus of the elastic layer having the cover layer was measured by using the test piece. Those results are shown in Table 1.

Example 2

A developing roller was produced and subjected to measurement in a similar way to that in Example 1 except that in the second film-forming step of Example 1, 5 sccm of hexamethyldisiloxane vapor was introduced into the vacuum chamber, the pressure in the vacuum chamber was adjusted to 3 Pa, and the treatment period of time was changed to 2,272 seconds. The results are shown in Table 1.

Example 3

A developing roller was produced and subjected to measurement in a similar way to that in Example 1 except that in the first film-forming step of Example 1, 5 sccm of hexamethyldisiloxane vapor and 250 sccm of oxygen were introduced into the vacuum chamber, the pressure in the vacuum chamber was adjusted to 46 Pa and the treatment period of time was set at 756 seconds, and except that the conditions in the second film-forming step of Example 1 were changed such that 10 sccm of hexamethyldisiloxane vapor was introduced into the vacuum chamber so that the pressure in the vacuum chamber was 3 Pa, the electric power was 70 W and the treatment period of time was 2,200 seconds. The results are shown in Table 1.

Example 4

A developing roller was produced and subjected to measurement in a similar way to that in Example 1 except that in the first film-forming step of Example 1, the treatment period of time was set at 207 seconds, and except that the conditions in the second film-forming step of Example 1 were changed such that a mixture gas of 10 sccm of hexamethyldisiloxane vapor and 10 sccm of toluene vapor was introduced into the vacuum chamber so that the pressure in the vacuum chamber was 6 Pa, the electric power was 70 W, and the treatment period of time was 1,200 seconds. The results are shown in Table 1.

Example 5

A developing roller was produced and subjected to measurement in a similar way to that in Example 1, except that in the second film-forming step of Example 1, 15 sccm of hexamethyldisiloxane vapor was introduced into the vacuum chamber, the pressure in the vacuum chamber was adjusted to 6 Pa, and the treatment period of time was set at 750 seconds. The results are shown in Table 1.

Example 6

A developing roller was produced and was subjected to measurement in a similar way to that in Example 1, except that in the first film-forming step of Example 1, 5 sccm of hexamethyldisiloxane vapor and 300 sccm of oxygen were introduced into the vacuum chamber, the pressure in the vacuum chamber was adjusted to 54 Pa, the electric power was set at 250 W and the treatment period of time was set at 500 seconds, and except that in the second film-forming step of Example 1, 20 sccm of hexamethyldisiloxane vapor was introduced into the vacuum chamber, the pressure in the vacuum chamber was adjusted to 7 Pa, the electric power was set at 150 W and the treatment period of time was set at 750 seconds. The results are shown in Table 1.

Example 7

A developing roller was produced and subjected to measurement in a similar way to that in Example 1, except that in the first film-forming step of Example 1, the treatment period of time was set at 5 seconds, and except that in the second film-forming step of Example 1, the treatment period of time was set at 8 seconds. The results are shown in Table 2.

Example 8

A developing roller was produced and subjected to measurement in a similar way to that in Example 1, except that in the first film-forming step of Example 1, the treatment period of time was set at 725 seconds, and except that in the second film-forming step of Example 1, the treatment period of time was set at 1,360 seconds. The results are shown in Table 2.

Example 9

A developing roller was produced and subjected to measurement in a similar way to that in Example 1, except that in the first film-forming step of Example 1, 20 sccm of hexamethyldisiloxane vapor was introduced into the vacuum chamber, the pressure in the vacuum chamber was adjusted to 7 Pa, the electric power was set at 150 W and the treatment period of time was set at 750 seconds, and except that in the second film-forming step of Example 1, a mixture gas of 5 sccm of hexamethyldisiloxane vapor and 200 sccm of oxygen was introduced into the vacuum chamber so that the pressure in the vacuum chamber was 54 Pa, the electric power was set at 250 W and the treatment period of time was set at 500 seconds. The results are shown in Table 2.

Example 10

A developing roller was produced and subjected to measurement in a similar way to that in Example 1, except that in the first film-forming step of Example 1, 3 sccm of hexamethyldisiloxane vapor was introduced into the vacuum chamber, the pressure in the vacuum chamber was adjusted to 3 Pa, the electric power was set at 250 W and the treatment period of time was set at 600 seconds, and except that in the second film-forming step of Example 1, 20 sccm of hexamethyldisiloxane vapor was introduced into the vacuum chamber, the pressure in the vacuum chamber was adjusted to 7 Pa, the electric power was set at 150 W and the treatment period of time was set at 500 seconds. The results are shown in Table 2.

Example 11

A developing roller was produced in a similar way to that in Example 1 except that the film-forming step was carried out in the following three stages.

(First Film-Forming Step)

A mixture gas of 10 sccm of hexamethyldisiloxane vapor and 5 sccm of toluene vapor, which was a raw material gas, was introduced into a vacuum chamber so that the pressure in the vacuum chamber was 5 Pa. After the pressure became constant, an electric power of 70 W with a frequency of 13.56 MHz was supplied to plate electrodes to generate plasma between the electrodes, and an elastic roller 1 was treated for 900 seconds while being rotated at 10 rpm.

(Second Film-Forming Step)

Subsequently, a mixture gas of 5 sccm of hexamethyldisiloxane vapor and 10 sccm of toluene vapor was introduced into the vacuum chamber so that the pressure in the vacuum chamber was 5 Pa. After the pressure became constant, an electric power of 70 W with a frequency of 13.56 MHz was supplied to plate electrodes to generate plasma between the electrodes, and the elastic roller 1 was treated for 900 seconds while being rotated at 10 rpm.

(Third Film-Forming Step)

Finally, a mixture gas of 20 sccm of hexamethyldisiloxane vapor and 30 sccm of toluene vapor was introduced into the vacuum chamber so that the pressure in the vacuum chamber was 13 Pa. After the pressure became constant, an electric power of 200 W with a frequency of 13.56 MHz was supplied to plate electrodes to generate plasma between the electrodes, and the elastic roller 1 was treated for 300 seconds while being rotated at 10 rpm. Then, a developing roller having a cover layer formed thereon was taken out from the vacuum chamber. The obtained developing roller was subjected to measurement in a similar way to that in Example 1. The results are shown in Table 2.

Example 12

A developing roller was produced and subjected to measurement in a similar way to that in Example 1, except that in the first film-forming step of Example 1, a mixture gas of 10 sccm of hexamethyldisiloxane vapor and 200 sccm of oxygen was introduced into the vacuum chamber so that the pressure in the vacuum chamber was 39 Pa, the electric power was set at 200 W and the treatment period of time was set at 204 seconds, and except that in the second film-forming step of Example 1, 8 sccm of hexamethyldisiloxane vapor was introduced into the vacuum chamber so that the pressure in the vacuum chamber was 4 Pa, the electric power was set at 200 W and the treatment period of time was set at 1,120 seconds. The results are shown in Table 2.

Example 13

A developing roller was produced and subjected to measurement in a similar way to that in Example 1, except that in the first film-forming step of Example 1, a mixture gas of 20 sccm of hexamethyldisiloxane vapor and 100 sccm of oxygen was introduced into the vacuum chamber so that the pressure in the vacuum chamber was 27 Pa, the electric power was set at 200 W and the treatment period of time was set at 105 seconds, and except that in the second film-forming step of Example 1, 10 sccm of hexamethyldisiloxane vapor was introduced into the vacuum chamber so that the pressure in the vacuum chamber was 6 Pa, the electric power was set at 70 W and the treatment period of time was set at 2,143 seconds. The results are shown in Table 3.

Example 14

A developing roller was produced and subjected to measurement in a similar way to that in Example 1 except that in the first film-forming step of Example 1, a mixture gas of 5 sccm of hexamethyldisiloxane vapor and 250 sccm of oxygen was introduced into the vacuum chamber so that the pressure in the vacuum chamber was 46 Pa and the treatment period of time was set at 750 seconds, and except that in the second film-forming step of Example 1, a mixture gas of 20 sccm of hexamethyldisiloxane vapor and 50 sccm of oxygen was introduced into the vacuum chamber so that the pressure in the vacuum chamber was 15 Pa, the electric power was set at 30 W and the treatment period of time was set at 904 seconds. The results are shown in Table 3.

Example 15

A developing roller was produced and subjected to measurement in a similar way to that in Example 1, except that in the first film-forming step of Example 1, the treatment period of time was set at 45 seconds, and except that in the second film-forming step of Example 1, the treatment period of time was set at 80 seconds. The results are shown in Table 3.

Example 16

A developing roller was produced and subjected to measurement in a similar way to that in Example 1, except that in the first film-forming step of Example 1, the treatment period of time was set at 430 seconds, and except that in the second film-forming step of Example 1, the treatment period of time was set at 820 seconds. The results are shown in Table 3.

Example 17

A developing roller was produced and subjected to measurement in a similar way to that in Example 1, except that the elastic roller 2 produced in Production Example 2 was employed as the elastic roller. The results are shown in Table 3.

Example 18

A developing roller was produced and subjected to measurement in a similar way to that in Example 1, except that the elastic roller 3 produced in Production Example 3 was employed as the elastic roller. The results are shown in Table 3.

Example 19

A developing roller was produced and subjected to measurement in a similar way to that in Example 1, except that the elastic roller 4 produced in Production Example 4 was employed as the elastic roller. The results are shown in Table 3.

Example 20

A developing roller was produced and subjected to measurement in a similar way to that in Example 1, except that the elastic roller 5 produced in Production Example 5 was employed as the elastic roller. The results are shown in Table 4.

Example 21

A developing roller was produced and subjected to measurement in a similar way to that in Example 1, except that the elastic roller 6 produced in Production Example 6 was employed as the elastic roller. The results are shown in Table 4.

Comparative Example 1

A developing roller was produced and subjected to measurement in a similar way to that in Example 1, except that in the first film-forming step of Example 1, a mixture gas of 20 sccm of hexamethyldisiloxane vapor and 100 sccm of oxygen was introduced into the vacuum chamber so that the pressure in the vacuum chamber was 27 Pa, the electric power was set at 200 W, and the treatment period of time was set at 105 seconds. The results are shown in Table 5.

Comparative Example 2

A developing roller was produced and subjected to measurement in a similar way to that in Example 1, except that in the first film-forming step of Example 1, a mixture gas of 5 sccm of hexamethyldisiloxane vapor and 250 sccm of oxygen was introduced into the vacuum chamber so that the pressure in the vacuum chamber was 46 Pa and the treatment period of time was set at 750 seconds, and except that in the second film-forming step of Example 1, 30 sccm of hexamethyldisiloxane vapor was introduced into the vacuum chamber so that the pressure in the vacuum chamber was 9 Pa, the electric power was set at 70 W and the treatment period of time was set at 449 seconds. The results are shown in Table 5.

Comparative Example 3

A developing roller was produced and subjected to measurement in a similar way to that in Example 1, except that in the first film-forming step of Example 1, the pressure in the vacuum chamber was set at 72 Pa, the electric power was set at 150 W and the treatment period of time was set at 200 seconds, and except that in the second film-forming step of Example 1, the pressure in the vacuum chamber was set at 12 Pa. The results are shown in Table 5.

Comparative Example 4

A developing roller was produced and subjected to measurement in a similar way to that in Example 1, except that in the second film-forming step of Example 1, 30 sccm of hexamethyldisiloxane vapor was introduced into the vacuum chamber so that the pressure in the vacuum chamber was 6 Pa, and the treatment period of time was set at 300 seconds. The results are shown in Table 5.

TABLE 1

| | | Example | | | | | |
|---|---|---|---|---|---|---|---|
| | | 1 | 2 | 3 | 4 | 5 | 6 |
| Thickness of cover layer: X (nm) | | 1504 | 1509 | 1515 | 1424 | 1502 | 1500 |
| Proportion of total number of elements Si, O, C and H with respect to number of all elements (%) | | 94.7 | 93.5 | 97.8 | 96.5 | 97.2 | 96.3 |
| (O/Si) | Maximum value | 1.48 | 1.48 | 1.50 | 1.95 | 1.48 | 1.95 |
| | Minimum value | 0.80 | 0.80 | 0.80 | 1.48 | 0.65 | 0.65 |
| (C/Si) | Maximum value | 1.20 | 0.44 | 1.57 | 1.65 | 1.20 | 1.65 |
| | Minimum value | 0.29 | 0.29 | 0.15 | 0.29 | 0.29 | 0.05 |
| | Maximum value/minimum value | 4.1 | 1.5 | 10.5 | 5.7 | 4.1 | 33.0 |
| | Value at a position 10 nm deep from top surface | 1.20 | 0.44 | 1.57 | 1.65 | 1.20 | 1.65 |
| | Value at a position (X-10) nm deep from top surface | 0.29 | 0.29 | 0.10 | 0.29 | 0.29 | 0.05 |
| Tensile modulus (MPa) | | 1.0 | 1.0 | 1.0 | 1.0 | 1.0 | 1.0 |

TABLE 2

| | | Example | | | | | |
|---|---|---|---|---|---|---|---|
| | | 7 | 8 | 9 | 10 | 11 | 12 |
| Thickness of cover layer: X (nm) | | 32 | 4993 | 1500 | 600 | 1576 | 1495 |
| Proportion of total number of elements Si, O, C and H with respect to number of all elements (%) | | 95.8 | 91.6 | 98.1 | 97.6 | 98.6 | 98.9 |
| (O/Si) | Maximum value | 1.48 | 1.48 | 1.95 | 0.65 | 1.90 | 1.50 |
| | Minimum value | 0.80 | 0.80 | 0.65 | 0.65 | 0.80 | 0.80 |
| (C/Si) | Maximum value | 1.20 | 1.20 | 1.65 | 1.65 | 1.50 | 0.55 |
| | Minimum value | 0.29 | 0.29 | 0.05 | 0.05 | 0.85 | 0.35 |
| | Maximum value/minimum value | 4.1 | 4.1 | 33.0 | 33.0 | 1.8 | 1.6 |
| | Value at a position 10 nm deep from top surface | 1.20 | 1.20 | 0.05 | 1.65 | 1.20 | 0.55 |
| | Value at a position (X-10) nm deep from top surface | 0.29 | 0.29 | 1.65 | 0.05 | 0.85 | 0.35 |
| Tensile modulus (MPa) | | 1.0 | 1.0 | 1.0 | 1.0 | 1.0 | 1.0 |

TABLE 3

| | | Example | | | | | |
|---|---|---|---|---|---|---|---|
| | | 13 | 14 | 15 | 16 | 17 | 18 |
| Thickness of cover layer: X (nm) | | 1492 | 1503 | 302 | 2987 | 1511 | 1504 |
| Proportion of total number of elements Si, O, C and H with respect to number of all elements (%) | | 99.2 | 97.6 | 96.4 | 93.8 | 94.8 | 94.2 |
| (O/Si) | Maximum value | 1.50 | 1.50 | 1.48 | 1.48 | 1.48 | 1.48 |
| | Minimum value | 0.80 | 0.90 | 0.80 | 0.80 | 0.80 | 0.80 |
| (C/Si) | Maximum value | 1.57 | 0.80 | 1.20 | 1.20 | 1.20 | 1.20 |
| | Minimum value | 0.90 | 0.15 | 0.29 | 0.29 | 0.29 | 0.29 |
| | Maximum value/minimum value | 1.7 | 5.3 | 4.1 | 4.1 | 4.1 | 4.1 |
| | Value at a position 10 nm deep from top surface | 1.57 | 0.80 | 1.20 | 1.20 | 1.20 | 1.20 |
| | Value at a position (X-10) nm deep from top surface | 0.90 | 0.15 | 0.29 | 0.29 | 0.29 | 0.29 |
| Tensile modulus (MPa) | | 1.0 | 1.0 | 1.0 | 1.0 | 10.0 | 30.0 |

TABLE 4

| | | Example | | |
|---|---|---|---|---|
| | | 19 | 20 | 21 |
| Thickness of cover layer: X (nm) | | 1504 | 1527 | 1504 |
| Proportion of total number of elements Si, O, C and H with respect to number of all elements (%) | | 98.3 | 96.2 | 98.6 |
| (O/Si) | Maximum value | 1.48 | 1.48 | 1.48 |
| | Minimum value | 0.80 | 0.80 | 0.80 |
| (C/Si) | Maximum value | 1.20 | 1.20 | 1.20 |
| | Minimum value | 0.29 | 0.29 | 0.29 |
| | Maximum value/minimum value | 4.1 | 4.1 | 4.1 |
| | Value at a position 10 nm deep from top surface | 1.20 | 1.20 | 1.20 |
| | Value at a position (X-10) nm deep from top surface | 0.29 | 0.29 | 0.29 |
| | Tensile modulus (MPa) | 100.0 | 110.0 | 0.7 |

TABLE 5

| | | Comparative example | | | |
|---|---|---|---|---|---|
| | | 1 | 2 | 3 | 4 |
| Thickness of cover layer: X (nm) | | 1504 | 1498 | 1718 | 1395 |
| Proportion of total number of elements Si, O, C and H with respect to number of all elements (%) | | 95.3 | 92.9 | 97.3 | 99.1 |
| (O/Si) | Maximum value | 1.50 | 1.50 | 1.98 | 1.48 |
| | Minimum value | 0.80 | 0.80 | 0.80 | 0.53 |
| (C/Si) | Maximum value | 1.20 | 1.70 | 1.20 | 1.42 |
| | Minimum value | 0.90 | 0.15 | 0.10 | 0.29 |
| | Maximum value/ minimum value | 1.3 | 11.3 | 12.0 | 4.9 |
| | Value at a position 10 nm deep from top surface | 1.20 | 1.70 | 1.20 | 1.42 |
| | Value at a position (X-10) nm deep from top surface | 0.90 | 0.15 | 0.10 | 0.29 |
| Tensile modulus (MPa) | | 1.0 | 1.0 | 1.0 | 1.0 |

<Evaluation of Developing Roller>

Each of the developing rollers which were obtained in the above described Examples and Comparative Examples was incorporated in an electrophotographic process cartridge of an electrophotographic laser printer (trade name: Color Laser Jet3600 which is made by Hewlett-Packard Company), as a developing roller. This cartridge was left for 12 hours in the environment of the temperature of 10° C. and the relative humidity of 30% RH, and then was left for 8 hours in the environment of the temperature of 25° C. and the relative humidity of 70% RH. Afterward, the cartridge was further left for 12 hours in the environment of the temperature of 40° C. and the relative humidity of 95% RH, and then was left for 8 hours in the environment of the temperature of 2520 C. and the relative humidity of 70% RH again.

This electrophotographic cartridge was installed in the above described electrophotographic laser printer, and electrophotographic images were output in the environment of the temperature of 30° C. and the humidity of 80% RH. The above described electrophotographic laser printer is a machine for outputting A4-sized paper in its longitudinal direction, which outputs a recording medium at an output speed of 16 ppm. In addition, the contacting pressure and intruding quantity of the developing roller to the toner-regulating member were set so that the amount of the toner carried on the developing roller was 0.35 mg/cm$^2$.

The image was formed by using a black toner. A solid black image (first solid black image) was firstly formed, and a halftone image having a reflection density of 0.7, which was measured by "Macbeth reflection densitometer RD-918" (which is trade name and is made by Macbeth), was formed as the image. Subsequently, 6,000 sheets of 1% printed matter were output, and then, a solid black image (second solid black image) and a solid white image both for evaluation were continuously formed.

Fogging and density unevenness were evaluated on thus obtained first solid black image, halftone image, second solid black image and solid white image.

After the solid white image was output, the surface of the developing roller was observed, and a crack in the cover layer, a state of filming and the peeling of the cover layer were evaluated.

(Crack in Cover Layer)

It was visually confirmed whether the streak originating in cracks in the cover layer of the developing roller were formed or not on the first solid black image and the halftone image, and the grade was decided according to the following criteria.

A: causing no streak.

B: causing no streak originating in cracks in the image though some streaks are observed.

C: Streaks are observed, and causing streak originating in cracks in the image as well.

(Toner Deposition-Fogging in Not-Printed Area)

A reflection density of the solid white image was measured with a photovoltaic reflection densitometer "TC-6DS/A"

(which is trade name and is made by Tokyo Denshoku Co., Ltd.). The difference between reflection densities of the solid white image and a not-printed area was defined as fogging (%) which was evaluated according to the following criteria.

A: being less than 1.5%.

B: being 1.5% or more but less than 3.0%.

C: being 3.0% or more.

(Density Unevenness in Printed Area)

The density unevenness of the first solid black image and the halftone image was visually observed, and was evaluated according to the following criteria. For information, the density unevenness is most easily observable in the halftone image and is relatively easily observable in the solid black image.

A: showing good image without causing visually observable density unevenness in any image.

B: causing observable density unevenness in the halftone image, but causing no observable density unevenness in the solid black image.

C: causing observable density unevenness in any image.

(Durability of Cover Layer)

After solid white images were output, it was confirmed whether peeling of a cover layer was observed or not when having observed the surface of a developing roller with a digital microscope "VH-8000" (which is trade name and is made by KEYENCE CORPORATION), and the degree of the peeling was evaluated according to the following criteria.

A: no observable peeling in the cover layer.

B: some observable peeling in the cover layer but being negligible.

C: clearly observable peeling in the cover layer.

(Fusion Adhesion—Filming of Toner on Surface of Developing Roller)

After solid white images were output, the surface of the developing roller was observed, and the filming was evaluated according to the following criteria based on an occurring state of the fusion-adhesion (so-called filming) of the toner onto the surface of the developing roller and the observation of the solid white image.

A: no filming on the developing roller.

B: no problem in the solid white image, but slight filming on the developing roller.

C: causing filming on the developing roller and some influence thereof occurring on the solid white image.

Furthermore, the developing roller which was obtained in the above described Examples and Comparative Examples was subjected to the following characteristic test as well.

(Test for Set and Bleeding Properties of Developing Roller)

The set and the bleed of a low-molecular-weight substance from the elastic layer, which occur because the developing roller is brought into pressure contact with a toner-regulating member, were tested in the following way.

Each of fresh developing rollers which were prepared in Examples and Comparative Examples was incorporated in the electrophotographic process cartridge of the above described electrophotographic laser printer, and was left for 30 days in a state of being brought into pressure contact with the toner-regulating member and the photosensitive drum in the environment of a temperature of 40° C. and a relative humidity of 95% RH. Subsequently, the electrophotographic process cartridge was incorporated in the above described laser printer, and a solid black image and a halftone image were output. The obtained solid black image and the halftone image were visually observed, and the presence or absence and a degree of the occurrence of the defects in the electrophotographic images caused by an adhesion of a substance having bled from the elastic layer to the photosensitive drum were evaluated according to the following criteria.

A: showing no image defect caused by adherence of bleeding substances.

B: showing image defects caused by adherence of bleeding substances, but being a degree of causing no problem in the image.

C: showing observable image defects caused by adherence of bleeding substances.

The evaluation results on the developing rollers according to Examples and Comparative Examples are shown in the following Table 6.

TABLE 6

| | Crack in surface layer | Fogging | Density unevenness | Durability | Filming | Test for set and bleeding properties |
|---|---|---|---|---|---|---|
| Example 1 | A | A | A | A | A | A |
| Example 2 | A | A | A | A | A | A |
| Example 3 | A | A | A | A | A | A |
| Example 4 | A | A | A | A | A | A |
| Example 5 | A | A | A | A | A | A |
| Example 6 | A | A | A | A | A | A |
| Example 7 | A | A | A | B | A | A |
| Example 8 | A | A | B | A | A | A |
| Example 9 | A | B | A | A | B | A |
| Example 10 | A | A | A | B | A | A |
| Example 11 | A | A | A | A | A | A |
| Example 12 | A | A | A | A | A | A |
| Example 13 | A | A | A | A | A | A |
| Example 14 | A | A | A | A | A | A |
| Example 15 | A | A | A | A | A | A |
| Example 16 | A | A | A | A | A | A |
| Example 17 | A | A | A | A | A | A |
| Example 18 | A | A | A | A | A | A |
| Example 19 | A | A | A | A | A | A |
| Example 20 | A | A | A | A | B | A |
| Example 21 | A | A | A | A | A | B |
| Comparative Example 1 | C | A | A | C | B | A |
| Comparative Example 2 | C | B | B | C | C | A |

TABLE 6-continued

| | Crack in surface layer | Fogging | Density unevenness | Durability | Filming | Test for set and bleeding properties |
|---|---|---|---|---|---|---|
| Comparative Example 3 | C | C | B | C | C | A |
| Comparative Example 4 | B | C | C | C | C | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-234777, filed Sep. 12, 2008, which is hereby incorporated by reference herein in its entirety.

What is claimed is:

1. A developing roller comprising:

a mandrel;

an elastic layer; and a cover layer functioning as a surface layer, wherein the cover layer comprises a silicon oxide film containing a carbon atom chemically bonded to a silicon atom, wherein, in the silicon oxide film, the proportion of the total number of the existing elements of a silicon atom, an oxygen atom, a carbon atom and a hydrogen atom to the number of all detected elements, as detected by using a high-frequency glow discharge light-emission surface analysis method, is 90% or more, and wherein the silicon oxide film has an abundance ratio of an oxygen atom chemically bonded to a silicon atom to silicon atoms, (O/Si), of 0.65 to 1.95, an abundance ratio of a carbon atom chemically bonded to a silicon atom to silicon atoms, (C/Si), of 0.05 to 1.65, and, has a ratio of the maximum value to the minimum value of the abundance ratio (C/Si) in a thickness direction of the cover layer of 1.5 to 33.0.

2. The developing roller according to claim 1, wherein when the value of the abundance ratio (C/Si) at a position 10 nm deep from the top surface of the cover layer is represented by A, and the value of the abundance ratio (C/Si) at a position (X −10) nm deep from the top surface of the cover layer is represented by B, where X represents the thickness of the cover layer, the following inequalities (1) and (2) are satisfied:

$$0.90<A\leqq 1.65 \quad (1); \text{ and}$$

$$0.05\leqq B\leqq 0.90 \quad (2).$$

3. The developing roller according to claim 1, wherein the thickness of the cover layer is 30 nm to 5,000 nm.

4. A developing method comprising the steps of:

forming a layer of a developer having a toner on the surface of a developing roller;

pressing the layer of the developer against a photosensitive member to supply the developer onto the surface of the photosensitive member to form a toner image thereon, wherein the developing roller is the developing roller according to claim 1.

5. An electrophotographic process cartridge that is detachably mountable to the main body of an electrophotographic image forming apparatus, the electrophotographic process cartridge comprising:

a developer having a toner;

a developer container that accommodates the developer therein;

a developer-quantity regulating blade;

a photosensitive drum; and a developing roller that is brought into pressure contact with the photosensitive drum, wherein the developing roller is the developing roller according to claim 1.

6. An electrophotographic image forming apparatus comprising:

a photosensitive drum; and a developing roller that is brought into pressure contact with the photosensitive drum, wherein the developing roller is the developing roller according to claim 1.

* * * * *